United States Patent [19]

Hatakeyama et al.

[11] Patent Number: 4,683,766

[45] Date of Patent: Aug. 4, 1987

[54] TRANSMISSION FOR SELF-PROPELLED WORKING VEHICLES

[75] Inventors: Sakichi Hatakeyama; Hiroshi Takahashi, both of Saitama, Japan

[73] Assignee: Honda Giken Kogyo Kabushiki Kaisha, Tokyo, Japan

[21] Appl. No.: 755,870

[22] Filed: Jul. 17, 1985

[30] Foreign Application Priority Data

Jul. 25, 1984 [JP] Japan ..... 59-154242

[51] Int. Cl.[4] ..... F16H 3/08

[52] U.S. Cl. ..... 74/333; 74/337; 192/55

[58] Field of Search ..... 74/333, 337; 192/55

[56] References Cited

U.S. PATENT DOCUMENTS

| | | | |
|---|---|---|---|
| 1,791,016 | 2/1931 | Sundh | 192/55 |
| 1,803,077 | 4/1931 | Spase | 192/55 X |
| 2,593,521 | 4/1952 | Ball | 192/55 |
| 3,167,272 | 1/1965 | Frode | 74/337 X |
| 3,265,172 | 8/1966 | Atsumi et al. | 192/55 |
| 3,580,351 | 5/1971 | Mollen | 74/194 X |
| 4,514,917 | 5/1985 | Ogano et al. | 192/3.54 X |

FOREIGN PATENT DOCUMENTS

| | | | |
|---|---|---|---|
| 155952 | 1/1921 | United Kingdom | 192/55 |

*Primary Examiner*—Leslie Braun
*Assistant Examiner*—Dwight G. Diehl
*Attorney, Agent, or Firm*—Armstrong, Nikaido, Marmelstein & Kubovcik

[57] ABSTRACT

A transmission for a self-propelled working vehicle (100) including an engine (2), and a load source (5, 21) adapted to be driven with drive power from the engine (2), in which the transmission (6) is interposed between the engine (2) and the load source (5, 21) and adapted to transmit the drive power to the load source (5, 21) while shifting same into one of at least two speed modes.

The transmission comprises at least two input gear members (37, 38) to which the drive power of the engine (2) is transmitted, at least two output gear members (48, 49) each respectively meshed with one of the input gear members (37, 38), a changeover mechanism (**52, 11, 48*a*, 49*a*, 10) for selectively bringing any one of the output gear members (48, 49) into operative connection to the load source (5, 21), and a friction type power transmitting mechanism (9) interposed between the engine (2) and the input gear members (37, 38**).

8 Claims, 3 Drawing Figures

6a
6b
6c
7b
7a
6
34
7
41
41a
24
38
43
42
8
5
27
37
35
39
40
44a
44
9
45
11a
49a
26
48a
46
10
11b
10a
36
47
48
51
6d
50
52
11
49
53

TRANSMISSION FOR SELF-PROPELLED WORKING VEHICLES

BACKGROUND OF THE INVENTION

1. Field of the Invention

The present invention generally relates to a transmission for self-propelled working vehicles. More particularly, the invention relates to a transmission for a self-propelled working vehicle in which the transmission is likely to experience large variations in the load thereon.

2. Description of Relevant Art

There are known self-propelled working vehicles of the type which includes an engine, a drive wheel, and a friction disc type transmission interposed therebetween to transmit drive power from the engine to the drive wheel, the transmission having a pair of friction plates arranged perpendicular to each other, and which further includes a working implement adapted to be driven by the engine, such as proposed in the U.S. Pat. No. 3,580,351 by I. J. Mollen, patented as of May 25, 1971.

In the U.S. Patent by Mollen, the working implement is given in the form of the combination of a snow-gathering auger and a snow blower. In other words, the U.S. Patent by Mollen has disclosed a self-propelled working vehicle in the form of a snow-removing tractor.

Although, when such snow-removing tractor is moving on the snow of which accumulation may be uneven depending such as on the ground surface and snow-fall conditions, the load that the transmission experiences may vary in accordance therewith, the transmission of friction disc type is able to effectively absorb such load variation, thus permitting the tractor to travel smoothly.

However, such snow-removing tractor is adapted to proceed performing a snow-removal work and thus has a travelling speed thereof preset to be remarkably low as of a vehicle, that is, as low as a walking speed of man, so that also the travelling to and from the working place is very slow.

To overcome such shortcoming, the transmission may first be so modified as to have at the drive side thereof a friction disc enlarged in the diametrical size and at the driven side thereof another friction disc correspondingly enlarged of the travel range. Such modification, however, is to unavoidably extend the dimensions of the transmission itself, thus scaling up the snow-removing tractor. In this respect, when taking into consideration the load variation attendant the travelling on the snow, it may be most favorable to employ a transmission of the friction disc type which is able to be adapted with a relatively simple construction to cope with such load variation. However, dimensional parameters of conventional transmissions of such type are determined to be best effective at a very low travelling speed, which implies that no modifications such as by the enlargement of drive disc diameter may bring into existence more than the lowerment in the durability of such transmission. This is because expanding the travel speed range of snow-removing tractor in such a manner as described above is to expand the reduction gear ratio of transmission, which means subjecting a friction disc thereof to larger torques.

In other words, it may be considerably difficult to expand the travel speed range of such snow-removing tractor without marring the inherent function of a friction disc type transmission and without enlarging the size thereof.

On the other hand, as a second possible modification, also the interposition of a sub-transmission between the friction disc type transmission as a main transmission and the drive wheel may well serve to expand the travel speed range of the snow-removing tractor. Such interposition, however, is to again give rise to an expansion of the reduction gear ratio of power transmission system like the case of the foregoing modification, thus causing the main transmission to be directly subjected to an increasing torque in reverse proportion to the gear ratio expansion, which is unfavorable to the durability of the main transmission.

In this respect also, it may be considerably difficult to expand the travel speed range of a conventional snow-removing tractor including a friction disc type transmission having a pair of friction discs arranged perpendicular to each other, without giving such unfavorable effect on the durability of the transmission.

To effectively solve such problems of conventional self-propelled working vehicle, particularly of a self-propelled working vehicle in the form of a snow-removing tractor, the present applicant has proposed in the Japanese patent application No. 58-93197, filed on May 25, 1983, a self-propelled working vehicle including an engine, a friction disc type transmission like above, and a sub-transmission of a gear changeover type interposed therebetween, the sub-transmission having a travel speed range staged into two modes. This Japanese patent application had a co-pending patent application in the Unites States, patented on May 7, 1985 as the U.S. Pat. No. 4,514,917.

In the self-propelled working vehicle according to the aforesaid Japanese patent application, the travel speed range is permitted to be favorably expanded, without giving rise to enlargement of the diametrical size of the friction disc type transmission as a main transmission and without giving mal-influences upon the durability of the main transmission.

However, even with such disposition of the sub-transmission of gear changeover type, the friction disc type main transmission with the paired friction discs perpendicular to each other is still unable to sufficiently absorb variations of the load acting thereon, thus failing to keep such load variations from reaching the sub-transmission and therebeyond to the engine, with the possiblity of affecting the durability of the sub-transmission and that of the engine.

Such problem is not so serious in such self-propelled working vehicles as according to the U.S. Patent by Mollen or the aforesaid Japanese patent application, since load variations like above can be absorbed to some extent by a friction disc type transmission which includes a pair of friction discs arranged perpendicular to each other.

However, in a self-propelled working vehicle including as a transmission thereof no more than a geared type having a travel speed range staged into, for example, five modes, those load variations experienced by the transmission are to be left as they act, without being absorbed, substantially directly on an engine.

Such inconveniency may be remarkable in an agricultural working vehicle which is intended to travel on such ground surfaces as much of variations in the undulations and ground state.

The present invention has been achieved to effectively overcome such problems of conventional self-propelled working vehicles, including the working vehicle according to the aforesaid Japanese patent application, as well as the working vehicle according to the U.S. Patent by Mollen, particularly of a self-propelled working vehicle such as an agricultural working vehicle having as a transmission thereof no more than a geared type.

SUMMARY OF THE INVENTION

According to the present invention, there is provided a transmission for a self-propelled working vehicle (100) including an engine (2), and a load source (5, 21) adapted to be driven with drive power from the engine (2), in which the transmission (6) is interposed between the engine (2) and the load source (21) and adapted to transmit the drive power to the load source (21) while shifting same into one of a set of at least two speed modes, comprising a set of at least two input gear members (37, 38) operatively connected to the engine (2) to have the drive power transmitted thereto from the engine (2), a set of at least two output gear members (48, 49) each respectively meshed with one of the input gear members (37, 38), a changeover mechanism (52, 11, 48*a*, 49*a*, 10) for selectively bringing any one of the output gear members (48, 49) into operative connection to the load source (21), and a friction type power transmitting mechanism (9) interposed between the engine (2) and the input gear members (37, 38) and adapted to operatively connect the engine (2) to the input gear members (37, 38).

Accordingly, an object of the present invention is to provide a transmission for self-propelled working vehicles, in which variations of load experienced by the transmission can be favorably absorbed to thereby effectively prevent influences of the load variations from reaching the engine.

The above and further features, objects and advantages of the present invention will more fully appear from the following detailed description of the preferred embodiment of the invention when the same is read in conjunction with the accompanying drawings.

DETAILED DESCRIPTION OF THE PREFERRED EMBODIMENT

Figure 1:
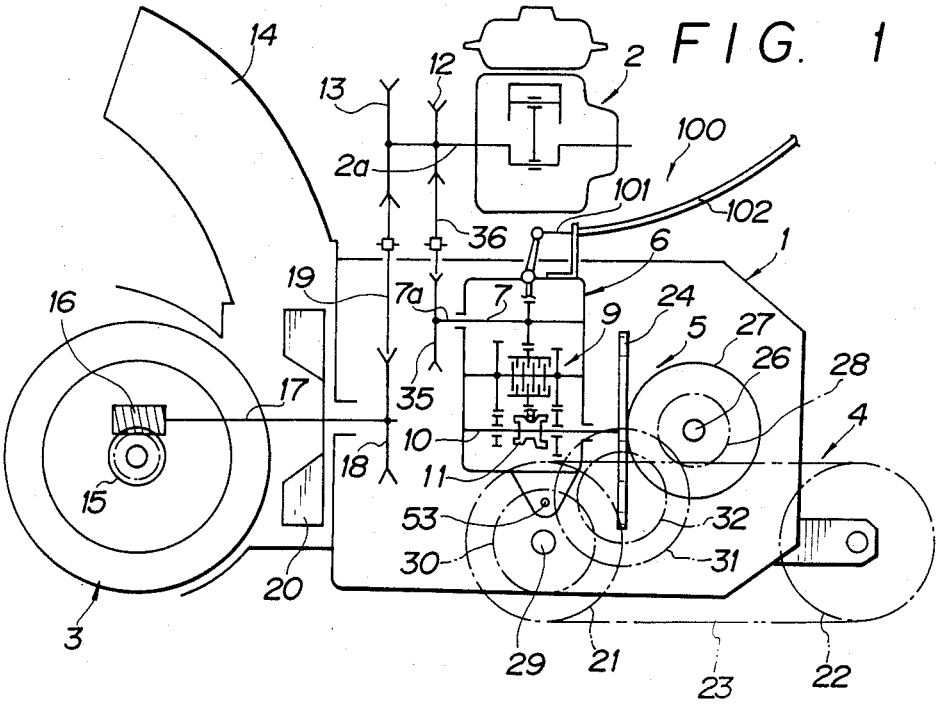
FIG. 1 is a schematic longitudinal sectional side view of a self-propelled working vehicle as a snow-removing tractor equipped with a transmission according to a preferred embodiment of the invention.

Referring first to FIG. 1, designated at reference numeral 100 is a self-propelled working vehicle in the form of a snow-removing tractor equipped with a transmission 6 according to the preferred embodiment of the invention.

At first, there will be given below a brief description of other constituent parts of the working vehicle 100, than the transmission 6, while they are analogous to corresponding ones of the self-propelled working vehicle according to the aforementioned Japanese patent application.

The working vehicle 100 is provided with a vehicle body 1, and includes an engine 2 mounted on the body 1, the engine 2 having an output shaft 2*a* thereof frontwardly projected therefrom for driving a pair of drive pulleys 12, 13 both fitted thereon. On the front side of the body 1 is provided a snow-blowing duct 14, and in front thereof, at a lower level, a transversely arranged snow-raking auger 3 which has for the driving thereof a worm wheel 15 driven with a worm 16, for which worm 16 a drive shaft 17 is longitudinally arranged. At the proximal end of the drive shaft 17 is fixed a driven pulley 18 cooperating with the drive pulley 13 to have a drive belt 19 stretched therebetween to be passed therearound, through which belt 19 the auger 3 is driven by engine power, so that the snow as raked by the auger 3 is blown up by a snow blower 20 through the duct 14 from which it is discharged outside.

Incidentally, in this embodiment, the auger 3 as well as the snow blower 20 is a working implement to be driven by the engine 2.

The vehicle body 1 is further fitted with a travelling mechanism 4 of a crawler belt type comprising a drive wheel 21, a guide wheel 22, and a crawler belt 23 stretched therebetween to be passed therearound. The travelling mechanism 4 is doubled to be disposed at the left and right of the body 1, and adapted to force the working vehicle 100 to travel by driving the drive wheel 21.

As a final mechanism for transmitting the power of the engine 2 to the drive wheel 21, there is provided a main transmission 5 of a friction disc type as described below.

Namely, the vehicle body 1 has therein a horizontally arranged output shaft 10 of the transmission 6, the shaft 10 extending in the longitudinal (fore to aft) direction thereof, on which shaft 10 a drive friction disc 24 is fixed to be thereby driven, on one hand. On the other hand, on a horizontally arranged input shaft 26 of the main transmission 5, which shaft 26 is oriented in the transverse (left-right) direction of the body 1, a driven friction disc 27 is spline-fitted to be axially slidable, the driven disc 27 being perpendicularly brought into frictional engagement with the drive disc 24. Further, the input shaft 26 has fixed thereon a drive gear 28 on one hand and, on the other hand, a drive axle 29 of the drive wheel 21 has fixed thereon a driven gear 30, with a pair of idle gears 31, 32 interposed therebetween, whereby the drive wheel 21 is adapted to be driven by the input shaft 26. The driven friction disc 27 is adapted, by the possible axial sliding thereof along the input shaft 26, to be carried in the radial direction of the drive friction disc 24, thereby permitting a final speed-change to be effected at the main transmission 5.

With respect to the flow of engine power, it is at the upstream side, that is, at the engine 2 side of the friction disc type transmission 5 that the aforesaid transmission 6 is installed, which transmission 6 is adapted to have a drive power from the engine 2 shifted into one of a plurality of speed modes, two modes in this embodiment, to be output to the main transmission 5.

Incidentally, in FIG. 1, designated at reference numeral 101 is a shift lever for actuating a later-described speed shifter 11, the shift lever 101 being operable from an unshown hand lever through a control cable 102.

Figure 3:
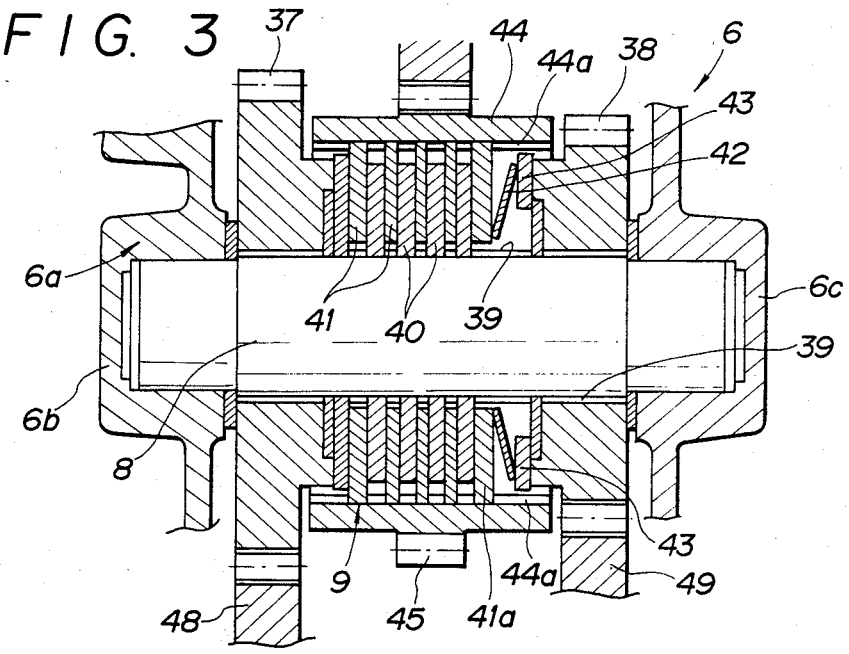
FIG. 3 is an enlarged view of an essential part of the transmission shown in FIG. 2.
Figure 2:
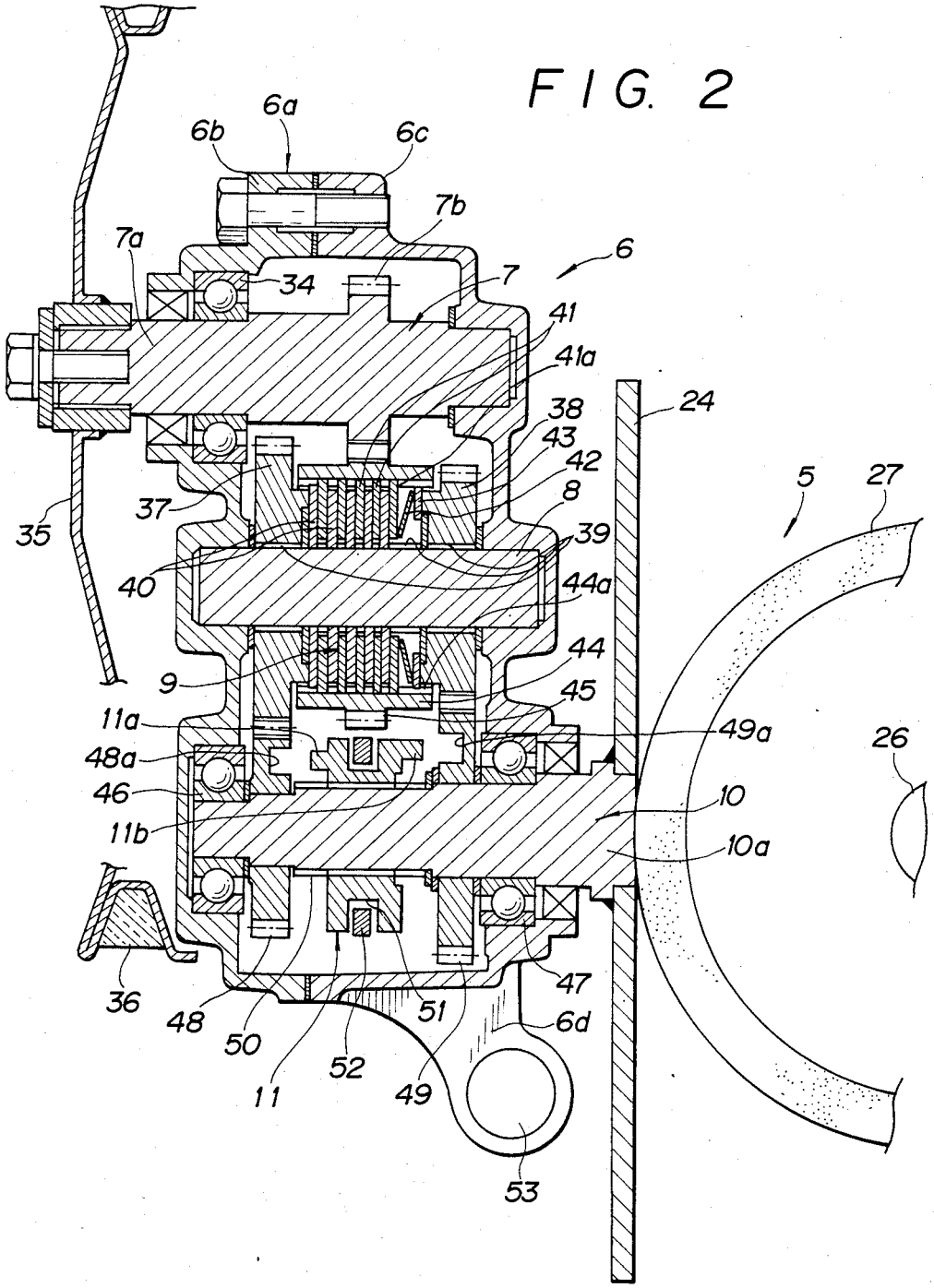
FIG. 2 is an enlarged view of the transmission shown in FIG. 1.

With reference to FIGS. 2 and 3, there will be described below the structure of the transmission 6.

The transmission 6 comprises a transmission casing 6*a* and various component members thereof accommodated in the casing 6*a*, as mentioned below. The transmission casing 6*a* consists of separable front and rear halves 6*b*, 6*c*, and has arranged in the upper part thereof a longitudinally arranged upper shaft 7, as a drive shaft at the engine side of the transmission 6, supported by a bearing 34, the shaft 7 being formed in the front part thereof with an extension 7*a* frontwardly projected through the transmission casing 6*a* to fix at the distal end thereof a driven pulley 35 interconnected through a drive belt 36 with the drive pulley 12 which is fixed on the output shaft 2*a* of the engine 2. The drive shaft, that is, the upper shaft 7 has, in the axially middle part thereof lying in the transmission casing 6*a*, a gear 7*b* formed thereon as a drive gear at the engine side.

Below the drive shaft 7, in the middle part of the transmission casing 6*a*, there is a longitudinally arranged middle shaft 8, which is free-rotatably supported as an input shaft of the transmission 6. The input shaft, that is, the middle shaft 8 has fixed thereon a large-diameter gear 37 and a small-diameter gear 38, which gears 37, 38 are axially spaced apart from each other to be located at front and rear end parts of the shaft 8, adjacent to the inner walls of the front and rear halves 6*b*, 6*c* of the transmission casing 6*a*, respectively, and fixedly engaged with corresponding parts of an axially splined portion 39 on the shaft 8, the splined portion 39 being continuous along the length of such part of the shaft 8 that lies between the respective inner walls of the halves 6*b*, 6*c* of the casing 6*a*, while the shaft 8 is fitted at both ends thereof into the inner walls of the casing 6*a*. The gears 37, 38 are adapted to function as a pair of input gears to input the engine power, as it is output from the drive gear 7*b*, toward transmission members in the lower part of the casing 6*a*.

On the input shaft 8, between the small-diameter gear 38 as a first input gear and the large-diameter gear 37 as a second input gear, there is provided a friction type power transmitting mechanism 9, which includes a plurality of annular disc-like driven friction plates 40 fitted on the splined portion 39 of the shaft 8 and axially spaced apart from each other, on one hand, and a plurality of drive friction plates 41 loose-fitted to be free around the shaft 8 and axially spaced apart so as to alternately overlap with the driven friction plates 40, on the other hand. The driven and drive friction plates 40, 41 are both all slidable in the axial direction of the input shaft 8, while normally being axially biassed all together toward either 37 of the input gears 37, 38, to thereby bring respective overlapping surfaces thereof into frictional engagement therebetween, with a conical plate spring 42 interposed to be loose-fitted on the shaft 8 between an anuular bearing plate 43 on the front face of the other 38 of the input gears 37, 38 and outermost one of the friction plates 40, 41 that is nearest thereto, that is, the rearmost one 41*a* of the drive friction plates 41 in this embodiment. The drive friction plates 41 are all fitted in a drive drum 44 comprising a short cylindrical member longitudinally arranged between the input gears 37, 38, the drum 44 having on the inner circumference thereof an axially splined portion 44*a* with which the drive friction plates 41 are each respectively axially slidably engaged at the outer circumference thereof, while the driven friction plates 40 are all loose-fitted to be free in the drum 44. On the outer circumference of the drum 44, in the axially middle part thereof is provided a ring-like driven gear portion 45 meshed with the drive gear 7*b* formed on the drive shaft 7. In this respect, the gear portion 45 may well be considered as a ring gear having a body part thereof shaped into a cylindrical form.

In the lower part of the transmission casing 6*a*, the aforementioned output shaft 10 is longitudinally arranged to be parallel with the drive shaft 7 and the input shaft 8, the output shaft 10 being rotatably supported by front and rear bearings 46, 47 and adapted to output the engine power, as it is input in the form of torque from the input gears 37, 38, to main transmission 5. The output shaft 10 is rearwardly projected through the transmission casing 6*a* to provide a rear extension 10 for supporting the drive friction disc 24 to be fixed thereon; and that part of the shaft 10 which lies between the inner walls of the casing 6*a* has loose-fitted thereon at the front side thereof a small-diameter gear 48 and at the rear side thereof a large-diameter gear 49, the gears 48, 49 constituting a pair of (driven) output gears axially spaced apart from each other to be axially fixed. On the remaining axially middle part of the shaft 10, there is provided a splined portion 50 axially extending between the gears 48, 49.

On the splined portion 50 is fitted the aforementioned speed shifter 11, which is axially slidably engaged therewith to permit the shift operation of speed mode to be effected by acutating the shifter 11 through the shift lever 101. The shifter 11 has formed on the front side thereof a frontward projection 11*a* and on the rear side thereof a rearward projection 11*b*, and in the outer circumference thereof a ring slot 51, in which a shift fork 51 is engaged to thereby axially actuate the shifter 11 to effect the shift operation. On the other hand, to cooperate with the frontward and rearward projections 11*a*, 11*b* to constitute front and rear dog clutches, in corresponding side faces of the output gears 48, 49 are formed front and rear recesses 48*a*, 49*a* selectively engageable with the projections 11*a*, 11*b*, respectively.

Incidentally, in FIG. 2, designated at reference numeral 53 is a support pin, on which a lower end portion 6*d* of the transmission casing 6*a* is pivotally supported. When necessary, by operating an unshown actuating mechanism, the casing 6*a* is somewhat inclined counterclockwise in FIG. 2 about the pin 53 as a pivot shaft, so that the drive friction disc 24 is disengaged from the driven friction disc 27, which disc 27 is thus relieved from frictional resistance therebetween and hence able to slide with ease along the input shaft 26 of the main transmission 5 to effect the speed change.

In the foregoing arrangement, the engine power is transmitted through the drive pulley 12, the drive belt 36, and the driven pulley 35 to the drive shaft 7, thereby driving the ring-gear, that is, the ring-like gear portion 45 meshed with the drive gear 7*b* formed on the drive shaft 7. The drive friction plates 41 fitted in the inner circumference of the drum 44 of the ring gear 45 are thus driven, driving the driven friction plates 40 which are normally biassed to be brought into friction engagement with the drive friction plates 41 by the conical plate spring 42, so that also the middle shaft 8 is driven into rotation by the driven friction plates 40, thus driving the input gears 37, 38 fixed on the input shaft 8. As a result, the output gears 48, 49 meshed with the input gears 37, 38, respectively, are always driven into rotation.

As shown in FIG. 2, while the shifter 11 is put in a neutral position thereof and thus neither of the projections 11*a*, 11*b* thereof is brought into engagement with the recesses 48*a*, 49*a* of the output gears 48, 49, these gears 48, 49 are both idling, thus transmitting no drive forces to the output shaft 10.

When the shifter 11 is moved from the neutral position of FIG. 2 in either axial direction thereof to selectively bring the projection 11*a* or 11*b* into engagement with the recess 48*a* of the output gear 48 or the recess 49*a* of the output gear 49, this gear 48 or 49 has rotational drive force thereof transmitted through the shifter 11 to the output shaft 10, which in turn drives the drive friction disc 24, thus driving the drive wheel 21, as already described.

In this embodiment, the combination of the input gear 38 of small diameter and the output gear 49 of large diameter constitutes a low-speed oriented gear train of the transmission 6, and the combination of the input gear 37 of large diameter and the output gear 48 of small diameter, a high-speed oriented gear train thereof.

The drive power from the engine 2 is thus shiftable into two speed modes, that is, high-speed mode and low-speed mode, before being transmitted to the friction disc type main transmission 5, where it has the rotation speed thereof changed in a non-stepped manner or continuously, through the combination of the drive and driven discs 24, 27, to be transmitted to the drive wheel 21 of the working vehicle 100.

As will be understood from the foregoing description, in the working vehicle 100 as a snow-removing tractor, a drive power transmitting route between from the engine 2 to the friction disc type transmission 5 includes the transmission 6 having two shift modes sharing the range of vehicle speed, so that the vehicle 100 is effectively adapted to travel at suitable low speeds while working to remove snow, and at favorable high speeds when going to and from the working place.

Moreover, by the disposition itself of the geared transmission 6, there is achieved a high-speed travelling of the working vehicle 100 without enlarging the diametrical size of the friction disc type main transmission 5 which is inherently adapted to absorb load variations to some extent.

Further, while the vehicle 100 is travelling, although at sudden variations in the road surface condition or of the travelling state the resulted variation in the load on the transmission 5 is at first absorbed by a slip between the drive and driven friction discs 24, 27 to a limitted extent proper to the transmission 5, even when the load variation has exceeded such an absorption limit of the friction discs 24, 27, thus tending to reversely transmit a load variation corresponding to an excess load over the absorption limit, beyond the main transmission 5, to the output shaft 10 and further upstream of the power flow through the trains of the gears 37, 48 or 38, 49, the ring gear 45, and the drive gear 7*b* to the drive shaft 7 located at the engine side of the transmission 6, this load variation due to the excess load will be favorably absorbed by slip actions between the drive and driven friction plates 41, 40 of the friction type power transmitting mechanism 9, thus being kept from being further reversely transmitted therebeyond toward the drive shaft 7, whereby the engine 2 as well as the transmission 6 is effectively protected against influences of load variations.

Furthermore, also when the engine torque is suddenly varied, the friction plates 40, 41 of the power transmitting mechanism 9 can effectively slip relative to each other to absorb torque variations, so that also the influence of such torque variation on the entirety of the transmission 6 can be favorably prevented.

Accordingly, the friction type power transmitting mechanism 9 is adapted to function not only as a load limitter but also as a torque limitter.

As will be apparent from the foregoing description, according to the present invention, in a self-propelled working vehicle with a fear of experiencing large variations in the load on a transmission thereof while travelling or working, there is provided a distinctive transmission (6) of a simple structure including a set of friction plates and a spring, which can effectively absorb such load variations if given, thus favorably protecting the transmission as well as an engine of the vehicle.

Further to the foregoing embodiment of the invention, the degree of frictional engagement between the friction plates 40, 41 in the transmission 6 may be adjusted by properly selecting the spring constant of the conical plate spring 42.

In the foregoing embodiment, the transmission 6 according to the present invention is applied to the self-propelled working vehicle 100 as a snow-removing tractor including the friction disc type transmission 5.

In this respect, it also will be apparent that the present invention is applicable also to a transmission for self-propelled working vehicles such as an agricultural working vehicle without friction disc type transmission and, besides, to a transmission adapted for transmitting engine power, not to a drive wheel, but to a snow-raking auger or blower or to a plow rotor.

Still further to the foregoing embodiment, it will be easily understood that the friction type power transmitting mechanism 9 put between the drive shaft 7 and the input shaft 8 may be effectively disposed at any point on a power transmission route in the transmission 6.

Yet further thereto, the transmission may advantageously have a greater number of speed-shift modes than two.

Although there has been described what is at present considered to be the preferred embodiment of the invention, it will be understood that the present invention may be embodied in other specific forms without departing from the spirit or essential characteristics thereof. The present embodiment is therefore to be considered in all respects as illustrative and not restrective. The scope of the invention is indicated by the appended claims rather than by the foregoing description.

I claim:

1. A transmission for a self-propelled working vehicle (100) including:

an engine (2) having a drive pulley (12) operatively connected thereto; and a load source (21) adapted to be driven with drive power from said engine (2), in which said transmission (6) is interposed between said engine (2) and said load source (21) and adapted to transmit the drive power to said load source (21) while shifting same into one of a set of at least two speed modes, comprising:

a driven pulley (35);

a drive belt stretched between said drive pulley (12) and said driven pulley (35);

a set of at least two input gear members (37, 38) operatively connected to said driven pulley (35) to have the drive power transmitted thereto from said engine (2) via said drive pulley (12) and said drive belt (36);

an input shaft (8) fitted with said input gear members (37, 38);

a set of at least two output gear members (48, 49) each respectively meshed with one of said input gear members (37, 38);

an output shaft (10) fitted with said output gear members (48, 49) and operatively connected to said load source (21);

a changeover mechanism (52, 11 48*a*, 49*a*) for selectively bringing any one of said output gear members (48, 49) into operative connection to said load source (21);

a friction type power transmitting mechanism (9) interposed between said driven pulley (35) and said input gear members (37, 38) and adapted to operatively connect said driven pulley (35) to said input gear members (37, 38), said friction type power transmitting mechanism (9) comprising a plurality of drive friction plates (41) operatively connected to said driven pulley (35) and adapted to be driven with the drive power from said engine (2), a plurality of driven friction plates (40) operatively connected to said input gear members (37, 38) and adapted to be each respectively brought into frictional engagement with one of said drive friction plates (41), and pressure exerting means (42) for exerting pressure to bring said drive friction plates (41) and said driven friction plates (42) into frictional engagement therebetween; and a drive gear member (7, 7*b*) interposed between said driven pulley (35) and said drive friction plates (41) of said friction type power transmitting mechanism (9) and adapted to transmit the drive power from said engine (2) to said drive friction plates (41);

whereby large variations in load and torque imposed on said transmission can be absorbed while said vehicle is traveling or working.

2. A transmission according to claim 1, wherein:

said drive gear member (7, 7*b*), said input shaft (8), and said output shaft (10) are parallel to one another;

said input gear members (37, 38) include at least one first input gear (38) having a diameter, and at least one second input gear (37) having a diameter relatively larger than the diameter of the first input gear; and said output gear members (48, 49) include a first output gear (49) having a diameter and normally meshing with said first input gear (38), and a second output gear (49) having a diameter relatively smaller than the diameter of said first output gear and normally meshing with the second input gear (37).

3. A transmission according to claim 2, wherein:

said input gear members (37, 38) including said first and second input gears (37, 38) are fixedly fitted on said input shaft (8); and said output gear members (48, 49) including said first and second output gears (48, 49) are free rotatably and axially non-slidably fitted on said output shaft (10).

4. A transmission according to claim 3, wherein:

said friction type power transmitting mechanism (9) further comprises a cylindrical drive drum (44) arranged around said input shaft (8) coaxially therewith and adapted to be driven with said drive gear member (7, 7*b*), and said drive drum (44) having formed on the outer circumference thereof a gear (45) normally meshed with said drive gear member (7, 7*b*);

said drive friction plates (41) of said friction type power transmitting mechanism (9) are fitted in said drive drum (44) axially slidably and relatively non-rotatably with respect thereto and adapted to be free from said input shaft (8);

said driven friction plates (40) of said friction type power transmitting mechanism (9) are fitted on said input shaft (8) axially slidably and relatively non-rotatably with respect thereto and adapted to be free from said drive drum (44); and said pressure exerting means (42) is arranged on said input shaft (8) and adapted for exerting pressure to urge said drive friction plates (41) and said driven friction plates (40) in the axial direction of said input shaft (8).

5. A transmission according to claim 4, wherein:

said drive drum (44), said drive friction plates (41), said driven friction plates (40), and said pressure exerting means (42) of said friction type power transmitting mechanism (9) are interposed between said first input gear (38) and said second input gear (37).

6. A transmission according to claim 5, wherein:

said pressure exerting means (42) comprises a spring member (42) interposed between the combination of said drive and driven friction plates (40, 41) and either of said first and second input gears (37, 38).

7. A transmission according to claim 6, wherein:

said changeover mechanism (52, 11, 48*a*, 49*a*, 10) comprises:

a recess (49*a*) formed in said first output gear (49);

a recess (48*a*) formed in said second output gear (48); and a shifter (11) fitted on said output shaft (10) axially slidably and relatively non-rotatably with respect thereto and formed with a projection (11*a*, 11*b*) adapted to be selectively engageable with either of said recesses (48*a*, 49*a*).

8. A transmission according to claim 1, wherein:

said load source (21) comprises a friction disc type transmission (5) having a pair of friction discs (24, 27) arranged perpendicular to each other.

* * * * *